US008480551B2

(12) United States Patent
Wnek

(10) Patent No.: US 8,480,551 B2
(45) Date of Patent: Jul. 9, 2013

(54) TOOL FOR FORMING A THREE DIMENSIONAL CONTAINER OR CONSTRUCT

(75) Inventor: Patrick H. Wnek, Sherwood, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 308 days.

(21) Appl. No.: 12/817,377

(22) Filed: Jun. 17, 2010

(65) Prior Publication Data

US 2010/0323864 A1 Dec. 23, 2010

Related U.S. Application Data

(60) Provisional application No. 61/187,849, filed on Jun. 17, 2009.

(51) Int. Cl.
*B31B 1/02* (2006.01)

(52) U.S. Cl.
USPC ..... 493/42; 493/143

(58) Field of Classification Search
USPC ..... 493/42, 143; 220/269; 425/468, 425/397, 400; 269/293, 294, 900; 264/320; 72/60, 82, 85
See application file for complete search history.

(56) References Cited

U.S. PATENT DOCUMENTS 228,554 A * 6/1880 Perkins et al. ..... 72/361
584,633 A * 6/1897 Gottlieb ..... 271/221
1,022,882 A 4/1912 Schwenn
1,733,445 A * 10/1929 Burns ..... 72/328
1,838,061 A * 12/1931 Schwaerzer ..... 72/329
2,522,397 A 9/1950 Palmer
2,634,880 A 4/1953 Gravatt
2,731,860 A * 1/1956 Schaming ..... 72/361
3,033,434 A 5/1962 Carson
3,099,377 A 7/1963 Metzler et al.
3,195,770 A 7/1965 Robertson
3,220,631 A 11/1965 Reifers
3,229,886 A 1/1966 Grogel
3,286,876 A 11/1966 Ring
3,530,917 A 9/1970 Donavan
3,669,305 A 6/1972 Kinney et al.
3,680,733 A 8/1972 Winslow
3,684,633 A 8/1972 Haase (Continued)

FOREIGN PATENT DOCUMENTS

DE 509 065 4/1969
DE 80 11 020 9/1980

(Continued)

OTHER PUBLICATIONS

International Search Report and Written Opinion from PCT/US2010/038953, dated Jan. 28, 2011.

(Continued)

*Primary Examiner* — Hemant M Desai
(74) *Attorney, Agent, or Firm* — Womble Carlyle Sandridge & Rice, LLP

(57) ABSTRACT

A tool having a blank positioning system and method for forming a container. The tool has a first tool assembly and a second tool assembly that cooperate to shape the container from a blank. The blank positioning system positions the blank between the first tool assembly and the second tool assembly prior to forming the blank into the container.

14 Claims, 8 Drawing Sheets

U.S. PATENT DOCUMENTS

| | | | | | |
|---|---|---|---|---|---|
| 3,850,340 | A | | 11/1974 | Siemonsen et al. | |
| 3,968,921 | A | | 7/1976 | Jewell | |
| 4,051,707 | A | | 10/1977 | Valek et al. | |
| 4,073,391 | A | * | 2/1978 | O'Brien et al. | 414/789 |
| 4,096,947 | A | | 6/1978 | Morse | |
| 4,139,115 | A | | 2/1979 | Robinson | |
| 4,183,435 | A | | 1/1980 | Thompson et al. | |
| 4,202,464 | A | | 5/1980 | Mohs et al. | |
| 4,358,263 | A | * | 11/1982 | Shiraishi et al. | 425/397 |
| 4,435,143 | A | * | 3/1984 | Dempsey | 425/150 |
| 4,606,496 | A | | 8/1986 | Marx et al. | |
| 4,609,140 | A | | 9/1986 | Van Handel et al. | |
| 4,645,155 | A | | 2/1987 | Eldon et al. | |
| 4,648,528 | A | | 3/1987 | LaBarge et al. | |
| 4,704,510 | A | | 11/1987 | Matsui | |
| 4,721,499 | A | | 1/1988 | Marx et al. | |
| 4,721,500 | A | | 1/1988 | Van Handel et al. | |
| 4,775,771 | A | | 10/1988 | Pawlowski et al. | |
| 4,781,566 | A | | 11/1988 | Rossi et al. | |
| 4,832,676 | A | | 5/1989 | Johns et al. | |
| 4,865,921 | A | | 9/1989 | Hollenberg et al. | |
| 4,890,439 | A | | 1/1990 | Smart | |
| 4,935,089 | A | | 6/1990 | Schirmer | |
| 4,936,935 | A | | 6/1990 | Beckett | |
| 4,963,424 | A | | 10/1990 | Beckett | |
| 4,967,908 | A | | 11/1990 | Kessler | |
| 5,039,364 | A | | 8/1991 | Beckett et al. | |
| 5,117,078 | A | | 5/1992 | Beckett | |
| 5,129,874 | A | * | 7/1992 | Hayes et al. | 493/167 |
| 5,190,209 | A | | 3/1993 | Gordon et al. | |
| 5,213,902 | A | | 5/1993 | Beckett | |
| 5,221,419 | A | | 6/1993 | Beckett | |
| 5,260,537 | A | | 11/1993 | Beckett | |
| 5,266,386 | A | | 11/1993 | Beckett | |
| 5,269,717 | A | | 12/1993 | Tardif | |
| 5,309,749 | A | | 5/1994 | Stodd | |
| RE34,683 | E | | 8/1994 | Maynard et al. | |
| 5,340,436 | A | | 8/1994 | Beckett | |
| 5,354,973 | A | | 10/1994 | Beckett | |
| 5,410,135 | A | | 4/1995 | Pollart et al. | |
| 5,424,517 | A | | 6/1995 | Habeger, Jr. et al. | |
| 5,519,195 | A | | 5/1996 | Keefer et al. | |
| 5,617,972 | A | | 4/1997 | Morano et al. | |
| 5,628,921 | A | | 5/1997 | Beckett | |
| 5,672,407 | A | | 9/1997 | Beckett | |
| 5,735,785 | A | | 4/1998 | Lucas et al. | |
| 5,755,824 | A | * | 5/1998 | Blechschmidt et al. | 470/42 |
| 5,758,773 | A | | 6/1998 | Clements | |
| 5,759,422 | A | | 6/1998 | Schmelzer et al. | |
| 5,782,376 | A | | 7/1998 | Brauner et al. | |
| 5,800,724 | A | | 9/1998 | Habeger et al. | |
| 5,934,472 | A | | 8/1999 | Ramirez et al. | |
| 5,938,112 | A | | 8/1999 | Sandstrom | |
| 6,093,460 | A | | 7/2000 | Iwaya | |
| 6,114,679 | A | | 9/2000 | Lai et al. | |
| 6,150,646 | A | | 11/2000 | Lai et al. | |
| 6,204,492 | B1 | | 3/2001 | Zeng et al. | |
| 6,213,301 | B1 | | 4/2001 | Landis et al. | |
| 6,251,451 | B1 | | 6/2001 | Zeng | |
| 6,325,213 | B1 | | 12/2001 | Landis, II | |
| 6,414,290 | B1 | | 7/2002 | Cole et al. | |
| 6,415,945 | B1 | | 7/2002 | Zank et al. | |
| 6,433,322 | B2 | | 8/2002 | Zeng et al. | |
| 6,455,827 | B2 | | 9/2002 | Zeng | |
| 6,552,315 | B2 | | 4/2003 | Zeng et al. | |
| 6,568,534 | B2 | | 5/2003 | Zank | |
| 6,592,357 | B1 | * | 7/2003 | Johns et al. | 425/397 |
| 6,677,563 | B2 | | 1/2004 | Lai | |
| 6,715,630 | B2 | * | 4/2004 | Littlejohn et al. | 220/573 |
| 6,717,121 | B2 | | 4/2004 | Zeng et al. | |
| 6,765,182 | B2 | | 7/2004 | Cole et al. | |
| 6,893,693 | B2 | * | 5/2005 | Swoboda et al. | 428/34.2 |
| 6,907,316 | B2 | | 6/2005 | Bader et al. | |
| 6,988,654 | B2 | | 1/2006 | Wnek | |
| 7,048,176 | B2 | * | 5/2006 | Littlejohn et al. | 229/406 |
| 7,169,346 | B2 | * | 1/2007 | Johns et al. | 264/320 |
| 7,337,943 | B2 | * | 3/2008 | Johns et al. | 229/406 |
| 7,365,292 | B2 | | 4/2008 | Cole et al. | |
| 7,419,462 | B1 | * | 9/2008 | Zelinski | 493/143 |
| 7,482,053 | B2 | * | 1/2009 | Swiontek | 428/213 |
| 7,540,833 | B2 | * | 6/2009 | Johns et al. | 493/152 |
| 7,819,790 | B2 | * | 10/2010 | Grischenko et al. | 493/73 |
| 7,862,318 | B2 | | 1/2011 | Middleton et al. | |
| 7,914,432 | B2 | * | 3/2011 | Zelinski | 493/143 |
| 8,047,834 | B2 | * | 11/2011 | Sofronie et al. | 425/394 |
| 2002/0092791 | A1 | | 7/2002 | Wnek | |
| 2003/0205319 | A1 | | 11/2003 | Bengtsson et al. | |
| 2004/0069788 | A1 | | 4/2004 | Johns | |
| 2004/0262322 | A1 | | 12/2004 | Middleton et al. | |
| 2005/0109653 | A1 | | 5/2005 | Wnek et al. | |
| 2006/0198972 | A1 | | 9/2006 | Ueda et al. | |
| 2007/0081743 | A1 | | 4/2007 | Kim | |
| 2007/0262487 | A1 | | 11/2007 | O'Hagan et al. | |
| 2007/0267374 | A1 | | 11/2007 | Middleton et al. | |
| 2008/0047958 | A1 | | 2/2008 | Cole et al. | |
| 2009/0223952 | A1 | | 9/2009 | Wnek et al. | |
| 2011/0160028 | A1 | | 6/2011 | Wnek | |

FOREIGN PATENT DOCUMENTS

| | | | |
|---|---|---|---|
| DE | 36 40 069 | | 9/1987 |
| DE | 87 13 290.7 | | 1/1988 |
| DE | 37 37 052 | A1 | 5/1989 |
| DE | 296 02 348 | U1 | 5/1996 |
| DE | 101 49 143 | A1 | 4/2003 |
| EP | 0 082 209 | | 6/1983 |
| EP | 1 332 972 | | 8/2003 |
| FR | 2 266 638 | | 10/1975 |
| FR | 2 599 002 | | 11/1987 |
| FR | 2 733 715 | | 11/1996 |
| GB | 1 264 484 | | 2/1972 |
| GB | 1 348 370 | | 3/1974 |
| GB | 1 376 603 | | 12/1974 |
| GB | 2 171 048 | | 8/1986 |
| JP | 47-23456 | | 10/1972 |
| JP | 54-116059 | | 9/1979 |
| JP | 54-126887 | | 10/1979 |
| JP | 56065866 | U | 6/1981 |
| JP | 59-75004 | | 4/1984 |
| JP | 62-131744 | | 8/1987 |
| JP | 03-004582 | | 1/1991 |
| JP | 3057020 | U | 5/1991 |
| JP | 6000843 | | 1/1994 |
| JP | 60-96234 | | 4/1994 |
| JP | 07-28883 | | 1/1995 |
| JP | 08-156944 | | 6/1996 |
| JP | 3031361 | | 9/1996 |
| JP | 8-337234 | | 12/1996 |
| JP | 08-337235 | | 12/1996 |
| JP | 09-254948 | | 9/1997 |
| JP | 11-138663 | | 5/1999 |
| JP | 2000-043840 | | 2/2000 |
| JP | 2000-142825 | | 5/2000 |
| JP | 2000-238760 | | 9/2000 |
| JP | 2000-335550 | | 12/2000 |
| JP | 2000-517260 | | 12/2000 |
| JP | 2001-213420 | | 8/2001 |
| JP | 2001-328617 | | 11/2001 |
| KR | 20-0367200 | Y1 | 11/2004 |
| WO | WO 96-11142 | | 4/1996 |
| WO | WO 98-09812 | | 3/1998 |
| WO | WO 03/066435 | | 8/2003 |
| WO | WO 03/078012 | | 9/2003 |
| WO | WO 2004-033324 | | 4/2004 |
| WO | WO 2008-049048 | | 4/2008 |
| WO | WO 2009-086501 | | 7/2009 |
| WO | WO 2009-088904 | | 7/2009 |

OTHER PUBLICATIONS

International Search Report and Written Opinion dated Sep. 5, 2011 for PCT/US2010/062303.

PCT/US2007/081743 International Search Report & Written Opinion, Nov. 22, 2010.

Japanese Office Action for 2012-516289 dated Apr. 18, 2013, with English translation.

Canadian Office Action for 2,761,154 dated Feb. 7, 2013.

* cited by examiner

TOOL FOR FORMING A THREE DIMENSIONAL CONTAINER OR CONSTRUCT

CROSS-REFERENCE TO RELATED APPLICATION

This application claims the benefit of U.S. Provisional Patent Application No. 61/187,849, filed Jun. 17, 2009.

INCORPORATION BY REFERENCE

U.S. Provisional Patent Application No. 61/187,849, which was filed on Jun. 17, 2009, is hereby incorporated by reference for all purposes as if presented herein in its entirety.

BACKGROUND OF THE DISCLOSURE

The present disclosure relates to tools and methods for forming materials into articles, elements, constructs, or containers that may be used to hold, contain, or prepare food products or other products.

SUMMARY OF THE DISCLOSURE

In one aspect, the disclosure is generally directed to a tool for forming a container from a blank. The tool has a blank locating feature that locates the blank in the tool for forming into the container.

In one aspect, the disclosure is generally directed to a tool for forming a container from a blank. The tool comprises a first tool assembly, and a second tool assembly. At least one of the first tool assembly and the second tool assembly is moveable between an open position of the tool wherein the blank is received between the first and the second tool assembly and a closed position of the tool wherein the blank is formed into the container. A blank positioning system is adjacent at least one of the first tool assembly and the second tool assembly. The blank positioning system has features for positioning the blank in an aligned position wherein the blank is axially aligned with the first tool assembly and the second tool assembly in the open position of the tool.

In another aspect, the disclosure is generally directed to a blank positioning system for use in a tool for forming a container from a blank. The tool has a first tool assembly and a second tool assembly. At least one of the first tool assembly and the second tool assembly is moveable between an open position of the tool wherein the blank is received between the first and the second tool assembly and a closed position of the tool wherein the blank is formed into the container. The blank positioning system comprises a blank infeed table adjacent the at least one of the first tool assembly and the second tool assembly, the blank infeed table being for positioning the blank in an aligned position wherein the blank is axially aligned with the first tool assembly and the second tool assembly in the open position of the tool.

In another aspect, the disclosure is generally directed to a method of forming a container from a blank. The method comprises obtaining a tool comprising a first tool assembly, a second tool assembly, and a blank positioning system, obtaining a blank to be formed into the container, positioning at least one of the first tool assembly and the second tool assembly in an open position of the tool, conveying the blank to the blank positioning system. The method comprises activating features of the blank positioning system to position the blank between the first tool assembly and the second tool assembly, wherein the blank is axially aligned with the first tool assembly and the second tool assembly. The conveying the blank comprises moving the blank from an upstream end of the tool assembly. The method comprises positioning at least one of the first tool assembly and the second tool assembly in a closed position of the tool and pressing the blank between the tool assemblies to form the blank into the container.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of materials, packages, elements, articles, containers and methods of making such materials, packages, elements, articles and containers. Although several different features, aspects, implementations, and embodiments are provided, numerous interrelationships between, combinations thereof, and modifications of the various features, aspects, implementations, and embodiments of the disclosure are contemplated hereby. In one illustrated embodiment, the present disclosure relates to forming a container for heating or cooking food items, such as in a microwave oven. However, in other embodiments, the disclosure can be related to forming articles or containers that are not used for microwave cooking.

The present disclosure includes a forming tool 1 for forming a container C (FIG. 8) suitable for use in heating or cooking a food item. The container C may be similar to the containers discloses in the following U.S. patents and U.S. patent applications: U.S. Pat. No. 7,365,292; U.S. Pat. App. Pub. Nos. 2005/0109653; 2008/0047958; 2008/049048; and 2007/0262487, the above-noted documents being incorporated by reference herein for all purposes. Also, the forming tool 1 of the present disclosure can have similar features to any of the various forming tools and forming features disclosed in the above-identified patents and published patent applications.

Figure 1:
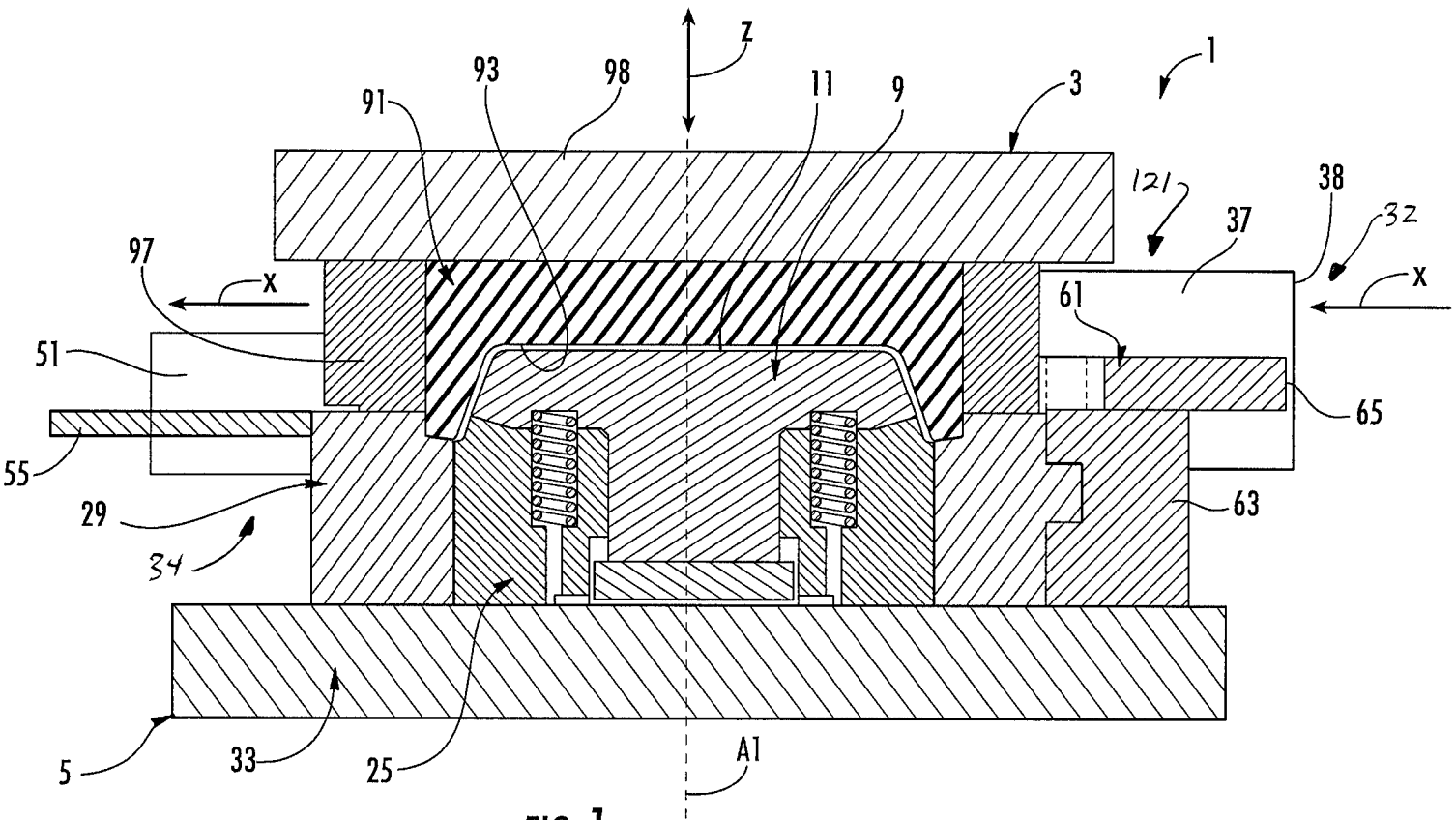
FIG. 1 is a cross-section of a forming tool of one embodiment of the disclosure.
Figure 2:
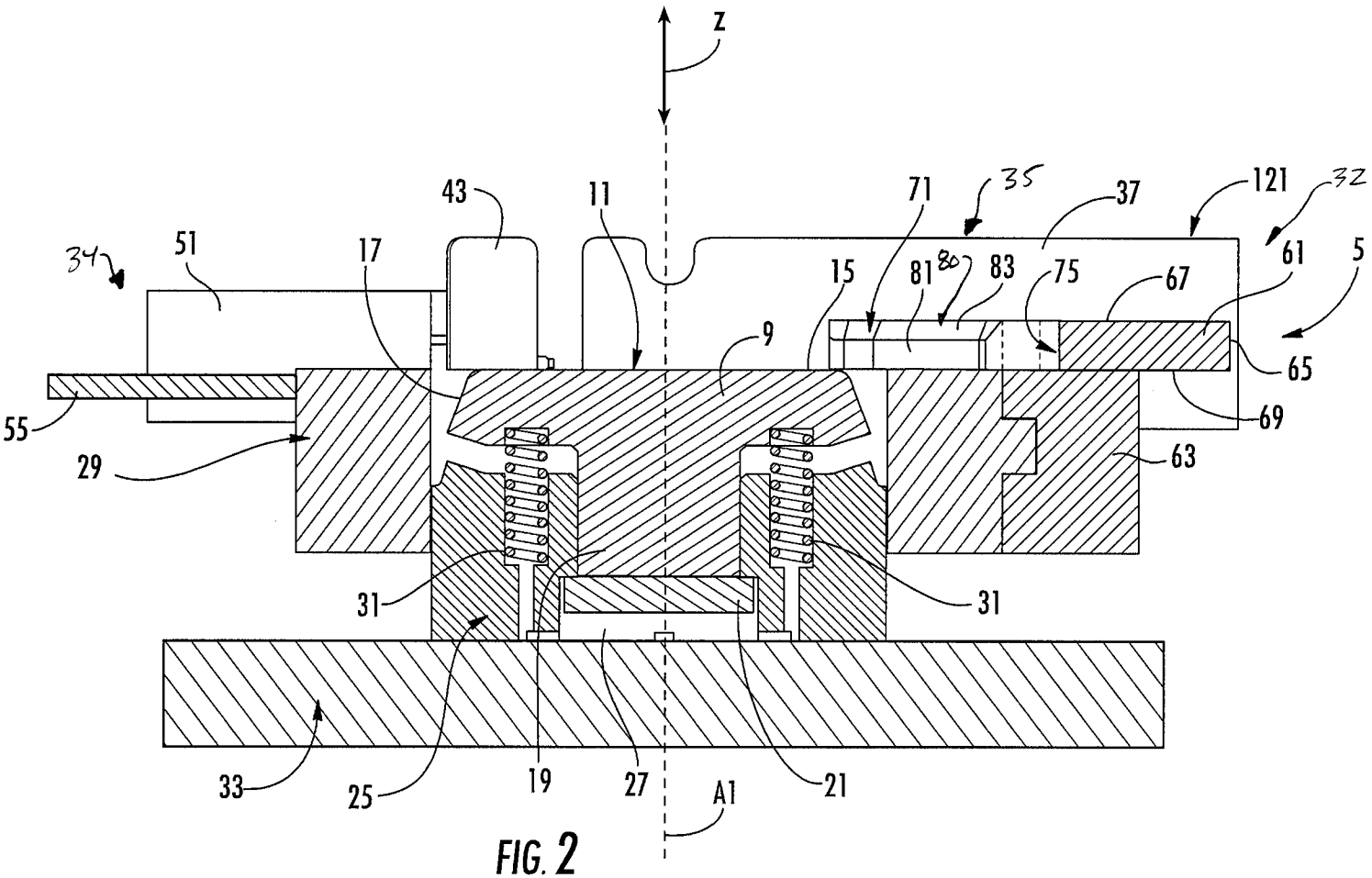
FIG. 2 is a cross-section of a lower tool assembly of FIG. 1.
Figure 5:
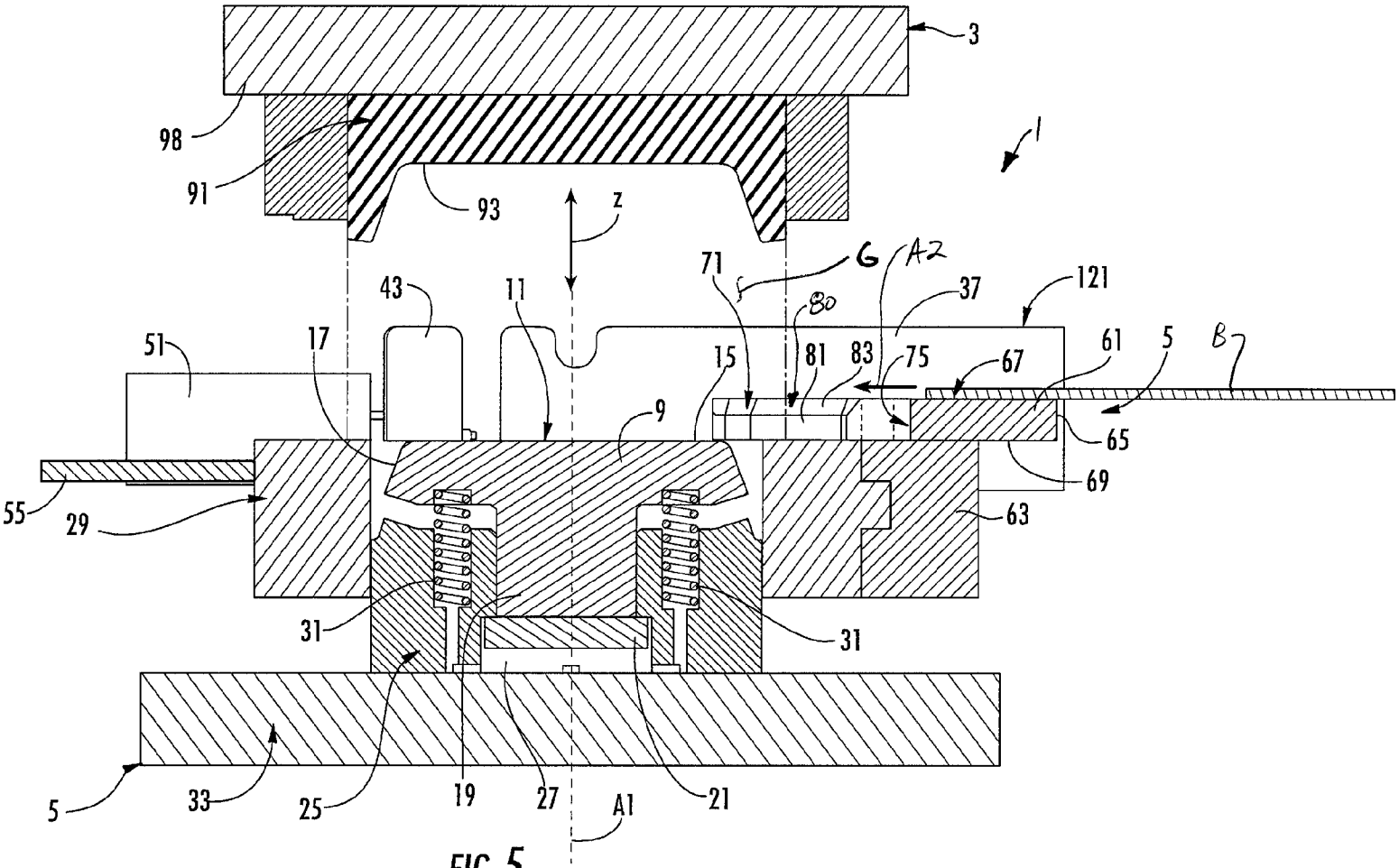
FIGS. 5-8 are cross-sections of the forming tool showing various positioning and steps of forming a blank into a construct.
Figure 6:
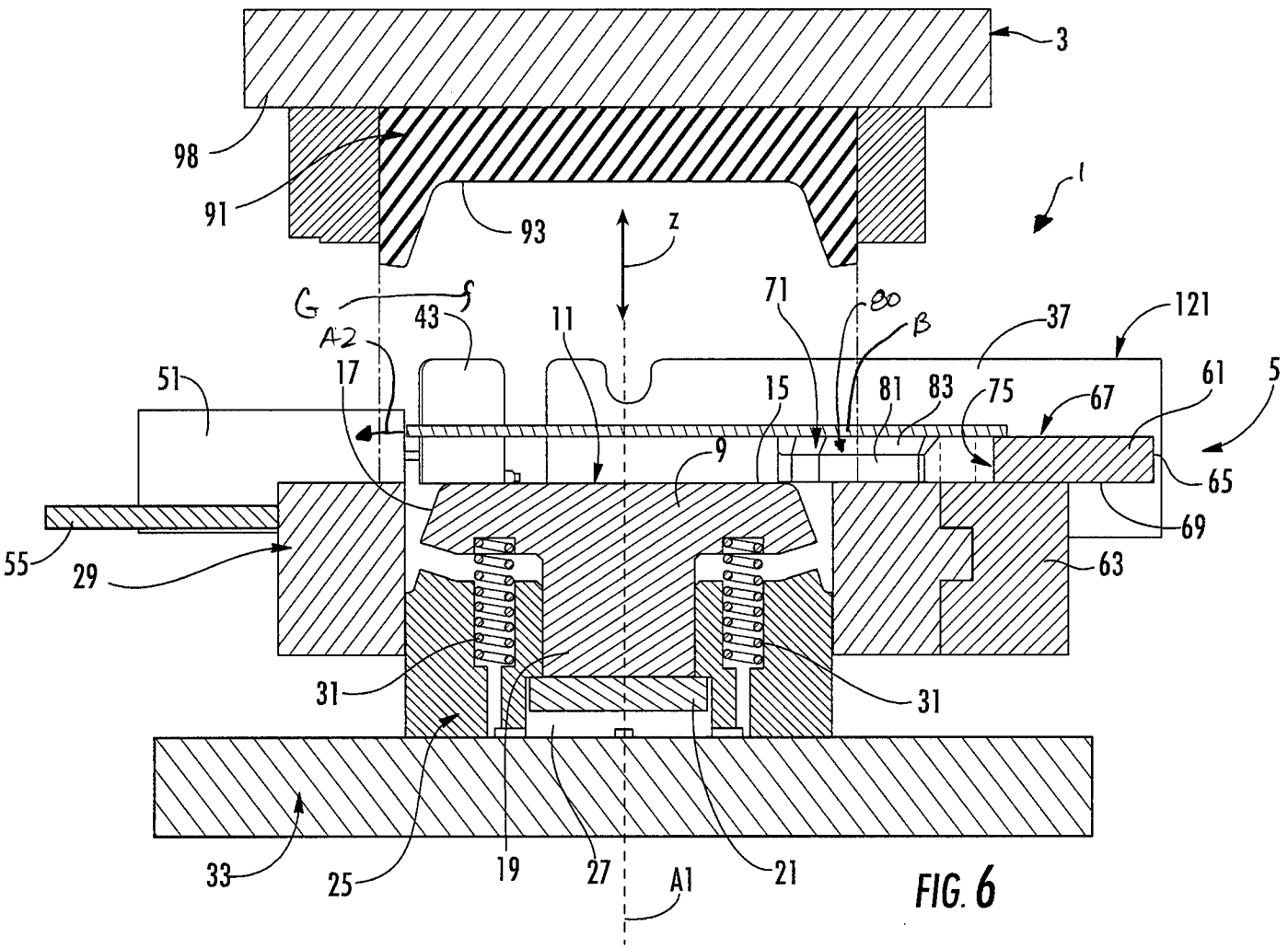

In the illustrated embodiment, the forming tool 1 includes an upper (first) tool assembly 3 and a lower (second) tool assembly 5. The upper and lower tool assemblies 3 and 5 are independently moveable in the vertical direction Z along a central axis A1 of the assembly to form a blank B into the three-dimensional container. It is understood that the upper and lower tool assemblies 3, 5 are moved in the vertical direction Z from the position shown in FIG. 1 to form a gap G (FIGS. 5 and 6) between the assemblies so that the blank B traveling in the horizontal direction X is located between the upper and lower tool assemblies prior to the forming process. In the illustrated embodiment, the upper and lower tool assemblies 3, 5 are configured to form the container C (FIG. 8) having a generally oval-shaped bottom wall BW and upwardly extending side walls S that form a generally oval-shaped cavity CV of the container. The upper and lower forming tool assemblies 3, 5 could be otherwise configured to form containers having other three-dimensional shapes (e.g., containers with circular-shaped bottom wall/cavity, containers with rectangular-shaped bottom wall/cavity, etc.). After being formed from the blank B in the forming tool 1, the container C can be discharged from the forming tool and further moved in the X-direction and subjected to additional forming or shaping processes, or can be further handled without departing from the scope of this disclosure.

Figure 3:
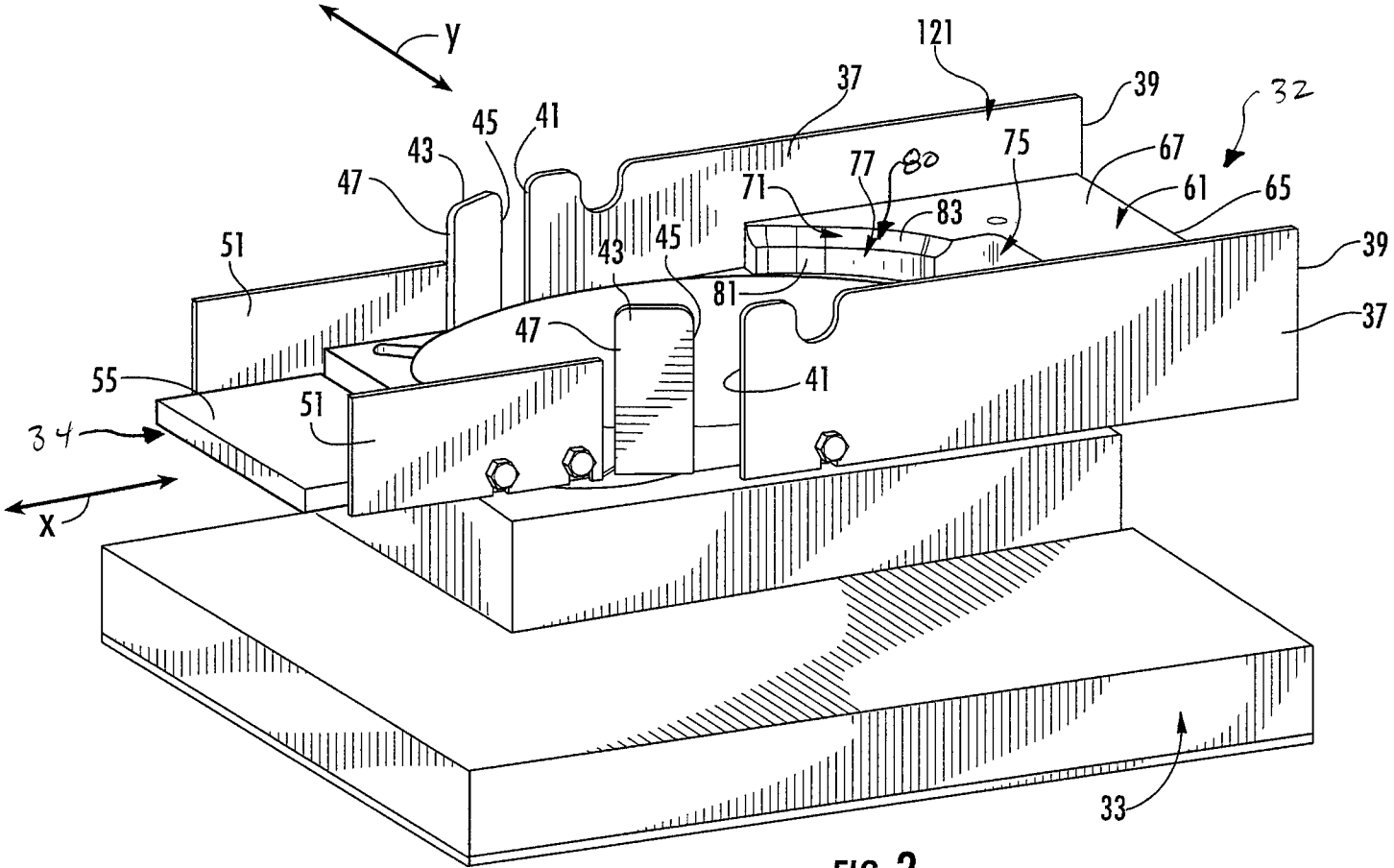
FIG. 3 is a perspective of the lower tool assembly.

In the illustrated embodiment, the lower tool assembly 5 has a nose 9 forming a first axial end surface 11 of the lower tool assembly. The nose 9 has a side surface 17 that extends downward from the axial surface 11. The nose 9 has a cylindrical shaft 19 connected to a guide bushing 21. The lower tool assembly 5 includes a base plate 25 having a central bore 27 that moveably receives the shaft 19 and the guide bushing 21. In the illustrated embodiment, the nose 9 is operatively connected to the base plate 25 by springs 31. A draw ring 29 is located adjacent the base plate 25 and extends around the perimeter thereof. The lower tool assembly 5 includes a bottom plate 33 that supports the base plate 25. In one embodiment, the draw ring 29 is moveable in the Z-direction relative to the bottom plate 33 and the base plate 25. As shown in FIG. 3, the lower tool assembly 5 has an upstream end 32 to which blanks are fed or conveyed in the X-direction, and downstream end 34 where containers C formed from the blanks are discharged from the tool 1 and further conveyed for packaging and/or further processing. It is understood that the tool could be otherwise oriented such that the upstream end 32 and downstream end 34 are otherwise positioned without departing from the disclosure.

In the illustrated embodiment, the tool 1 comprises a blank positioning system 121 mounted on the lower tool assembly 5, generally at the upstream end 32 of the tool. In one, embodiment, the blank positioning system 121 comprises first blank guides 37 that are attached at opposite sides of the lower tool assembly 5 to guide the blank B and prevent movement of the blank in the Y-direction (FIG. 3) that is perpendicular to the direction of travel of the blank (X-direction). The first blank guides 37 each have a respective upstream end 39 and a respective downstream end 41. In the illustrated embodiment, the blank positioning system 121 includes middle blank guides 43 that are located adjacent the outer surface of the draw ring 29 and a respective upstream end 39 of the first blank guides 37. In the illustrated embodiment, the middle blank guides 43 are angled with respect to the first blank guides 37 and have a respective upstream end 45 and downstream end 47. In the illustrated embodiment, the lower tool assembly 5 comprises exit guides 51 that are located adjacent the downstream ends 47 of the middle blank guides 43. An exit plate 55 is located at a downstream side of the draw ring 29 and is between the exit guides 51. In one embodiment, the exit guides 51 are positioned to be in a generally parallel planar relationship with the first blank guides 37, but are spaced inward from and are separated by a smaller distance in the X-direction than the first blank guides. In the illustrated embodiment, the first blank guides 37, middle blank guides 43, and exit blank guides 51 are generally rectangular plates that extend upward from and are generally perpendicular to the axial end surface 11 of the nose 9. The blank guides 37, 43, 51 can be alternatively shaped, arranged, and/or located without departing from this disclosure.

Figure 4A:
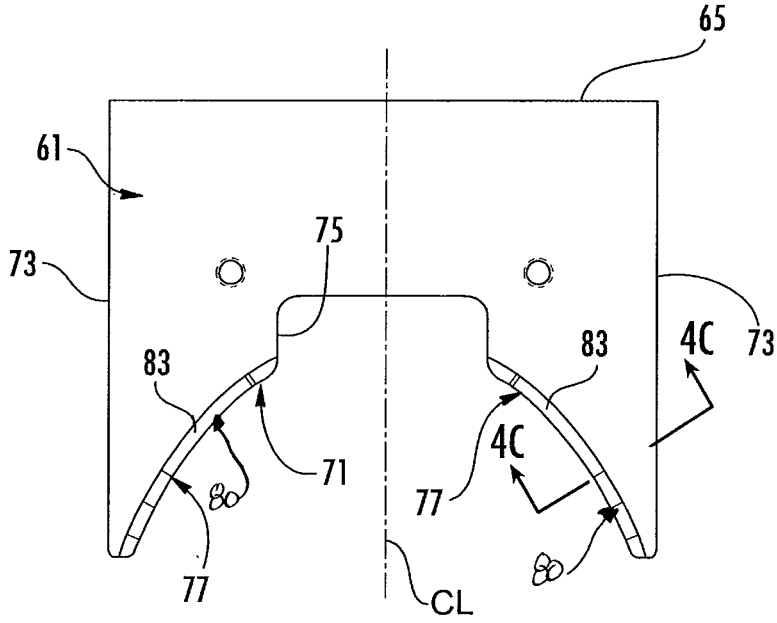
FIG. 4A is a top plan view of a blank infeed table of the lower tool assembly.
Figure 4B:
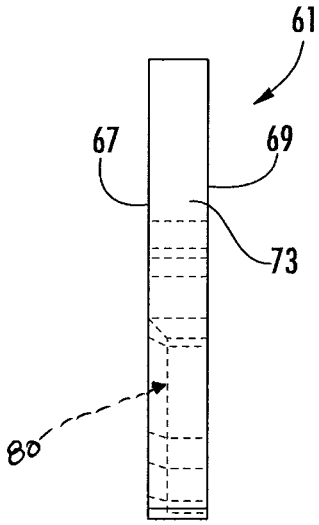
FIG. 4B is a side view of the blank infeed table of FIG. 4A.
Figure 4C:
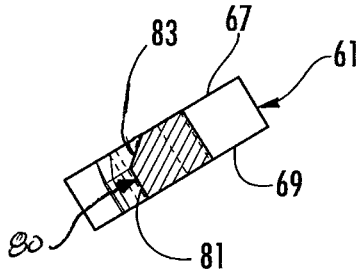
FIG. 4C is a cross-section of the blank infeed table taken along plane 4C-4C of FIG. 4A.

In the illustrated embodiment, the blank positioning system 121 comprises a blank infeed table 61 located at the upstream side of the lower tool assembly 5. The blank infeed table 61 is supported above the bottom plate 33 of the lower tool assembly 5 by a support 63. The blank infeed table 61 is shown in detail in FIGS. 4A-4C. The blank infeed table 61 has a generally flat upstream end surface 65, an upper surface or face 67, a lower surface or face 69, a downstream end surface 71, and two opposed side surfaces 73. The opposed side surfaces 73 are adjacent a respective one of the first blank guides 37. In the illustrated embodiment, the downstream end surface 71 has a generally rectangular notch 75 located on the centerline CL of infeed table 61 and two arcuate portions 77 respectively extending from the rectangular notch. In one embodiment, each of the two arcuate portions 77 of the downstream end surface 71 includes a blank guiding surface 80 comprising a lower portion 81 that extends generally perpendicular from the bottom surface 69 and an upper portion 83 that is contoured and extends obliquely (in cross-sectional view of FIG. 4C) from the lower portion to the top face 67. In the illustrated embodiment, the upper portion 83 of the blank guiding surface 80 is positioned at an angle of at least approximately 60 degrees relative to the flat top surface 67 of the infeed table 61. However, the upper portion 83 could be otherwise shaped and/or arranged (e.g., angled more or less than 60 degrees relative to the top surface 67) without departing from the disclosure. The blank infeed table 61 could be otherwise shaped, arranged, and/or positioned without departing from the disclosure.

In the illustrated embodiment, the upper tool assembly 3 includes a cavity block or cavity 91 having a recess 93 generally shaped to correspond with the shape of the container C. A clamp ring 97 is located adjacent an outer radial surface of the cavity block 91. The clamp ring 97 is operatively connected to a base plate 98. The upper tool assembly 3 can be otherwise shaped, arranged, and/or configured and can have more or less than the components shown and described herein without departing from the disclosure.

In the illustrated embodiment, the lower tool assembly 5 includes the blank positioning system 121 at the upstream side of the forming tool assembly 1 that comprises the first blank guides 37, middle blank guides 43, and the blank infeed table 61. The blank positioning system 121 provides precise positioning of the blank B in the X and Y-directions prior to forming the blank B into the container C. In one embodiment, the blank B is generally oval-shaped and is slid across the blank infeed table 61 and is positioned by the blank positioning system 121 to be in the proper location above the lower forming tool assembly 5 prior to press-forming the blank into the container.

A method of forming the container C from the blank is described below. The container of the present disclosure is formed from the blank B by feeding the blank into the forming tool assembly 1 and operating the assembly to press and shape the blank into the container. The blank B can be moistened to facilitate forming of the container C. After the upper tool assembly 3 and lower tool assembly 5 have been separated (FIG. 5) to form the gap G, the blank B is slid across the blank infeed plate 61 and is positioned in between the upper and lower tool assemblies 3, 5 by the first blank guides 37 and middle blank guides 43 of the blank positioning system 121. A conveying mechanism, such as a conveyor belt (not shown) or other suitable material handling mechanism, conveys the blank B in the direction of arrow A1 to the proper position between the upper tool assembly 3 and lower tool assembly 5. At the fully open position of the upper and lower tool assemblies 3, 5, the blank is supported by the axial end surface 11 of the nose 9 and the draw ring 29 on the lower tool assembly.

Figure 7:
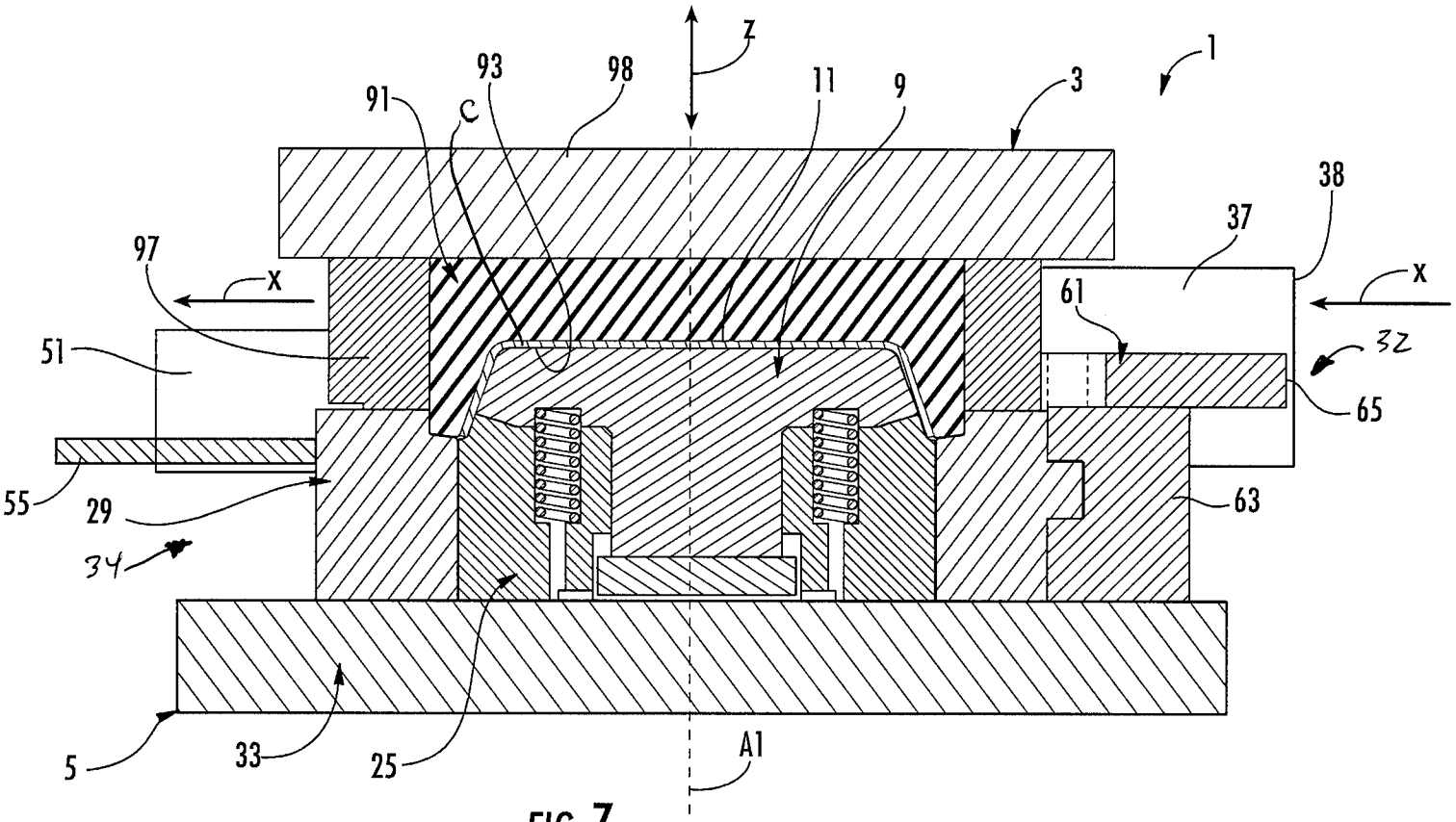
Figure 8:
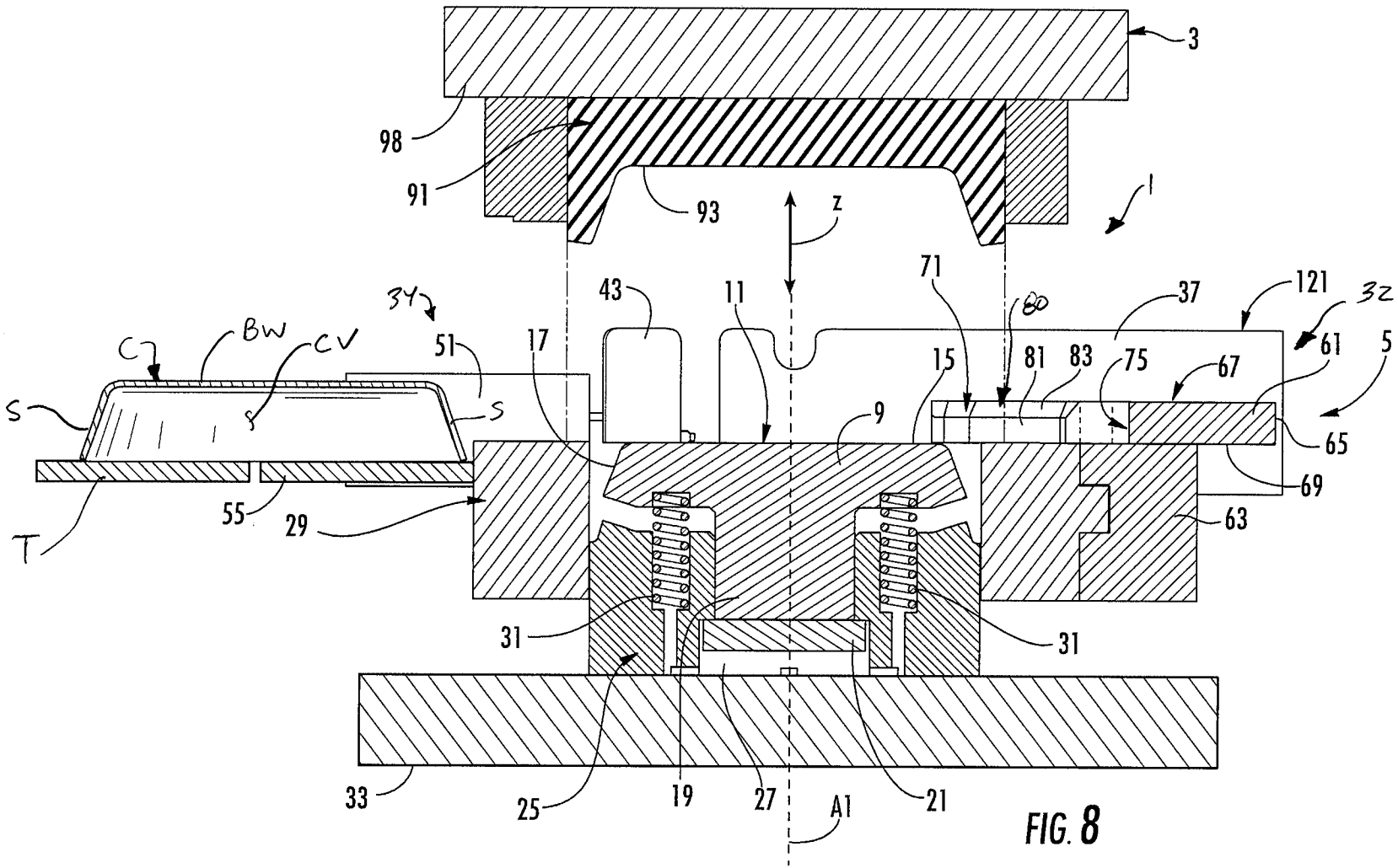

After the blank B is positioned in the proper, centered position above the lower tool assembly by the blank positioning system 121, the upper tool assembly 3 is actuated to initiate downward movement toward the lower tool assembly 5. The blank B is pressed between the nose 9 and the cavity block 91 so that the blank is pressed into a three-dimensional shape of the container C (FIGS. 7 and 8).

In addition to the capability of forming articles from a generally oval-shaped blank, the X and Y-directional position control of the blank positioning system 121 can be beneficial in forming any three-dimensional article or container from blanks that are other than oval-shaped. For example, the forming tool 1 could form a container, having a cavity that is otherwise shaped (e.g., round, square, rectangular, etc.), from an appropriately sized and shaped blank. In one embodiment, the container could be a three dimensional container such as a tray having a bottom wall and at least one side wall.

After the container C is shaped (FIG. 7), the upper tool assembly 3 is raised and the container C is ejected from the tool assembly 1 (FIG. 8) such that the container exits the downstream end of the tool assembly such that the container is supported by the exit plate 55 and is guided by the exit guides 51. The container can be further conveyed in the X-direction by a conveying mechanism (e.g., conveyor belt) for further processing, packaging, and/or shipment or for assembly into a finished food product package. In the illustrated embodiment a table T or support surface is adjacent to the exit plate 55, but the table T could be a portion of a conveying mechanism that further conveys the containers C.

In one embodiment, the upper tool assembly 3 and lower tool assembly 5 can be mounted at approximately a 45° angle in a machine (not shown) of the type manufactured by Peerless Machine & Tool Corporation in Marion, Ind., USA. The machine provides the primary compressive forces to sufficiently close and open the tool assemblies 3, 5 of the present disclosure. The closing and opening of the tool assemblies 3, 5 by the machine forms the three-dimensional articles or containers C. In other types of machines, the tool assemblies 3, 5 may be revised/modified to permit the tool assemblies to operate in alternative orientations (e.g., upside down or on their side). It should be understood that the operating position of tool assemblies 3 and 5 shown and/or described herein is not intended to limit the scope of the disclosure.

As mentioned above, in accordance with the exemplary embodiment of the present disclosure, the container can include microwave interactive material that may comprise a microwave interactive element such as a susceptor. The container can include microwave interactive elements or material as is disclosed in any of the U.S. patents and Published patent applications that are noted above and incorporated by reference herein. Alternatively, the microwave interactive material can comprise any other type of microwave interactive elements, materials, and/or various combinations of microwave interactive elements and material, as discussed in greater detail below. The microwave interactive elements and materials may be omitted from the container without departing from the scope of this disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tool for forming a container from a blank, the tool comprising:

a first tool assembly;

a second tool assembly; at least one of the first tool assembly and the second tool assembly being moveable between an open position of the tool wherein the blank is received between the first and the second tool assembly and a closed position of the tool wherein the blank is formed into the container; and a blank positioning system adjacent at least one of the first tool assembly and the second tool assembly, the blank positioning system having features for positioning the blank in an aligned position wherein the blank is axially aligned with the first tool assembly and the second tool assembly in the open position of the tool; and the blank positioning system comprises a blank infeed table adjacent the at least one of the first tool assembly and the second tool assembly, the blank infeed table has an upstream end surface, a downstream end surface, opposite side surfaces, an upper face, a lower face, and a blank guiding surface comprising a contoured upper portion adjacent the upper face, and the blank positioning system further comprises a pair of blank guides adjacent the blank infeed table, each of the pair of blank guides extends above the upper face of the blank infeed table.

2. The tool of claim 1 wherein the blank guiding surface comprises a lower portion adjacent the lower face, the upper portion of the blank guiding surface extends downwardly from the upper face to the lower portion.

3. The tool of claim 1 wherein each of the pair of blank guides comprises a generally rectangular plate that is attached to the at least one of the first tool assembly and the second tool assembly.

4. The tool of claim 1 wherein the blank guides are first blank guides and the blank positioning system comprises a pair of middle blank guides positioned in a downstream direction from the pair of first blank guides, wherein each of the pair of middle blank guides is positioned at an angle with respective to a respective one of the pair of first blank guides.

5. The tool of claim 4 wherein each of the pair of middle blank guides comprises a generally rectangular plate that is attached to the at least one of the first tool assembly and the second tool assembly.

6. The tool of claim 4 further comprising a pair of exit guides positioned in a downstream direction from the blank positioning system, the pair of exit guides being for positioning the container as it exits the tool assembly.

7. The tool of claim 6 wherein each of the pair of exit guides comprises a generally rectangular plate that is attached to the at least one of the first tool assembly and the second tool assembly.

8. The tool of claim 6 further comprising an exit plate positioned between each of the pair of exit guides, the exit plate being for supporting the container as it exits the tool assembly.

9. The tool of claim 1 wherein the first tool assembly comprises a nose having an external surface shaped to generally correspond to at least a portion of the container and the second tool assembly comprises a cavity block having a recess shaped to correspond with at least a portion of the container, the nose and the cavity block cooperating to form the container from the blank when the nose is at least partially received in the cavity block.

10. A blank positioning system for use in a tool for forming a container from a blank, the tool having a first tool assembly, and a second tool assembly, at least one of the first tool assembly and the second tool assembly being moveable between an open position of the tool wherein the blank is received between the first and the second tool assembly and a closed position of the tool wherein the blank is formed into the container, the blank positioning system comprising:

a blank infeed table adjacent the at least one of the first tool assembly and the second tool assembly, the blank infeed table being for positioning the blank in an aligned position wherein the blank is axially aligned with the first tool assembly and the second tool assembly in the open position of the tool, the blank infeed table has an upstream end surface, a downstream end surface, opposite side surfaces, an upper face, a lower face, and a blank guiding surface comprising a contoured upper portion adjacent the upper face; and a pair of blank guides adjacent the blank infeed table, each of the pair of blank guides extends above the upper face of the blank infeed table.

11. The blank positioning system of claim 10 wherein the blank guiding surface comprises a lower portion adjacent the lower face, the upper portion of the blank guiding surface extends downwardly from the upper face to the lower portion.

12. The blank positioning system of claim 10 wherein each of the pair of blank guides comprises a generally rectangular plate that is attached to the at least one of the first tool assembly and the second tool assembly.

13. The blank positioning system of claim 10 wherein the blank guides are first blank guides and further comprising a pair of middle blank guides positioned in a downstream direction from the pair of first blank guides, wherein each of the pair of middle blank guides is positioned at an angle with respective to a respective one of the pair of first blank guides.

14. The blank positioning system of claim 13 wherein each of the pair of middle blank guides comprises a generally rectangular plate that is attached to the at least one of the first tool assembly and the second tool assembly.

* * * * *